United States Patent [19]

Kesel et al.

[11] Patent Number: 4,930,984

[45] Date of Patent: Jun. 5, 1990

[54] IMPELLER

[75] Inventors: Bruno Kesel; Gerhard Zink, both of Bühl; Karin Winter, Gaimersheim, all of Fed. Rep. of Germany

[73] Assignee: Robert Bosch GmbH, Stuttgart, Fed. Rep. of Germany

[21] Appl. No.: 379,804

[22] Filed: Jul. 13, 1989

[30] Foreign Application Priority Data

Sep. 21, 1988 [DE] Fed. Rep. of Germany ..... 3832026

[51] Int. Cl.[5] ..... F04D 29/66

[52] U.S. Cl. ..... 416/203; 416/175; 416/189

[58] Field of Search ..... 416/203, 175 R, 189 R; 123/41.11, 41.49, 41.65, 41.66

[56] References Cited

U.S. PATENT DOCUMENTS

| | | | |
|---|---|---|---|
| 1,831,729 | 11/1931 | Adamcikas et al. | 416/203 |
| 1,868,008 | 7/1932 | Gardner | 416/203 |
| 1,888,056 | 11/1932 | Verzillo et al. | 416/203 |
| 2,120,780 | 6/1938 | Geise | 416/203 |
| 3,058,528 | 10/1962 | Hiersch | 416/203 |
| 3,842,902 | 10/1974 | Poslusny | 123/41.49 X |
| 4,358,245 | 11/1982 | Gray | 416/189 |
| 4,441,462 | 4/1984 | Budinski | 123/41.49 X |
| 4,474,534 | 10/1984 | Thode | 416/203 X |
| 4,548,548 | 10/1985 | Gray | 416/192 X |
| 4,685,513 | 8/1987 | Longhouse et al. | 416/189 R X |
| 4,729,714 | 3/1988 | Wrobel | 416/203 X |

FOREIGN PATENT DOCUMENTS

| | | | |
|---|---|---|---|
| 1177277 | 9/1964 | Fed. Rep. of Germany | 416/203 |
| 2524555 | 12/1975 | Fed. Rep. of Germany | 416/203 |
| 85594 | 7/1981 | Japan | 416/203 |

*Primary Examiner*—Everette A. Powell, Jr.
*Attorney, Agent, or Firm*—Michael J. Striker

[57] ABSTRACT

An impeller comprises a central hub part, and a plurality of vanes extending from the central hb part, the plurality of vanes including two first neighboring vanes having a predetermined construction and at least one second vane located between the first vanes and having a construction which is different from the construction of the first vanes.

5 Claims, 2 Drawing Sheets

IMPELLER

BACKGROUND OF THE INVENTION

The present invention deals with an impeller. More particularly, it deals with an impeller which has a central hub part and a plurality of vanes extending therefrom.

Impellers of the above mentioned general type are known in the art. One of such impellers is disclosed, for example, in U.S. Pat. No. 4,358,245. During operation of such impeller in other words when the impeller rotates, a disturbing rotation sound occurs. It is especially undesirable when the impeller is used as a blower for cooling of an internal combustion engine of a power vehicle.

SUMMARY OF THE INVENTION

Accordingly, it is an object of the present invention to provide an impeller which avoids the disadvantages of the prior art.

More particularly, it is an object of the present invention to provide an impeller which can be used as an acoustically determined axial blower and thereby at least significantly reduce the disturbing rotation sound.

In keeping with these objects and with others which will become apparent hereinafter, one feature of the present invention resides, briefly stated, in an impeller which has a central hub part and a plurality of vanes extending therefrom, wherein between two neighboring vanes of an identical construction, at least one vane of a construction which is different from the construction of the two vanes is provided.

When the impeller is designed in accordance with the present invention it avoids the disadvantages of the prior art.

In accordance with another feature of the present invention, at least one group of the vanes has a physical construction which is different from the physical construction of the other vanes.

Still another feature of the present invention is that at least one vane with a different construction is arranged within several vanes which include a plurality of neighboring vanes.

Still another feature of the present invention is that several vanes of a different construction are arranged between two neighboring vanes of the first mentioned construction.

A further feature of the present invention is that the additional vane of a different construction has a sickle shape different from the respective sickle shape of the other vanes.

Still a further feature of the present invention is that the free ends of the vanes which are spaced from the hub part are surrounded by a ring whose axial length is greater than its radial length.

The ring can be provided on its one end side with a funnel-shaped expanded portion which has a uniform radius in a cross-section.

A further feature of the present invention is that the curvature of the sickle-shaped vane is opposite to the direction of rotation of the impeller.

On the other hand, the curvature of the sickle-shaped vane can extend in the rotary direction of the impeller.

The cross-sectional profiles of the vanes can also differ from one another.

Finally, there can be several groups of vanes, which have different profiles.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
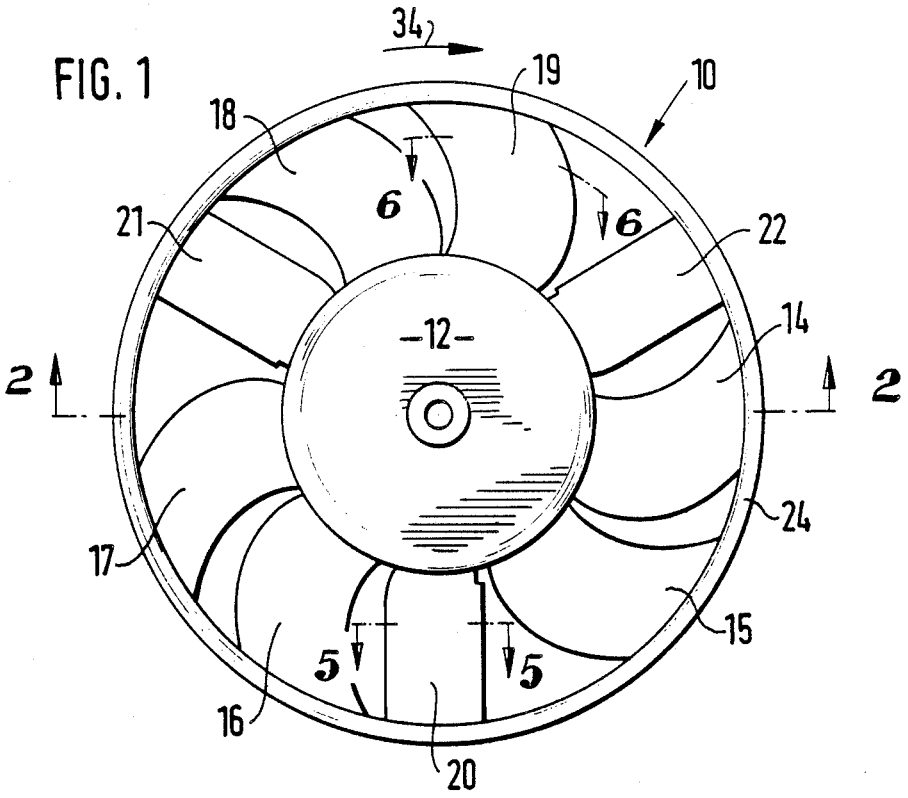
FIG. 1 is a plan view of an impeller in accordance with the first embodiment of the present invention.
Figure 2:
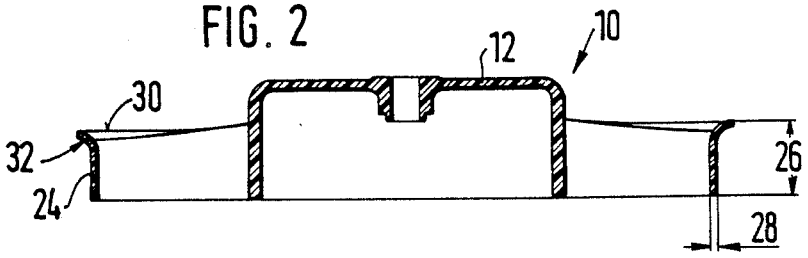
FIG. 2 is a view showing a section taken along the line I—I in FIG. 1.

An impeller according to the present invention shown in FIGS. 1 and 2 is identified as a whole with reference numeral 10. It has a central hub part 12 and a plurality of radially extending vanes 14–19 which are sickle-shaped relative to a straight plane intersecting the axis of rotation of the impeller. The vanes are located substantially in a plane of rotation.

As can be seen from FIG. 1, a further vane 20, 21, 22 is located respectively between the vanes 15 and 16, 17 and 18, and 19 and 14. They have a contour which is different from the sickle-shaped contour. In a concrete case, in accordance with this embodiment, the vanes 20, 21, 22 which are different from the sickle-shaped form extend directly in a radial direction. In this embodiment there are six vanes with sickle-shaped contour and three vanes with the contour which deviates from the sickle-shaped contour. The distribution of the vanes is uniform. It is recommended that between the neighboring vanes with the sickle-shape, several vanes with the contour deviating from the sickle-shape are provided.

As can be further seen from FIGS. 1 and 2, the ends of all vanes 14 to 19 and 20 to 22, which are remote from the hub part 12, are surrounded by a ring 24 connected therewith. Its axial size 26 is greater than its radial size. As can be seen further from FIG. 1, the ring at its one end side 30 is provided with a funnel-shaped expanded portion with a uniform radius 32 as seen in a cross-section. The rotary direction of the impeller 10 is identified in FIG. 1 with an arrow 34. With respect to its rotary direction 34, the curvature of the sickle-shaped vanes 14–19 is opposite to the direction of rotation of the impeller.

Figure 3:
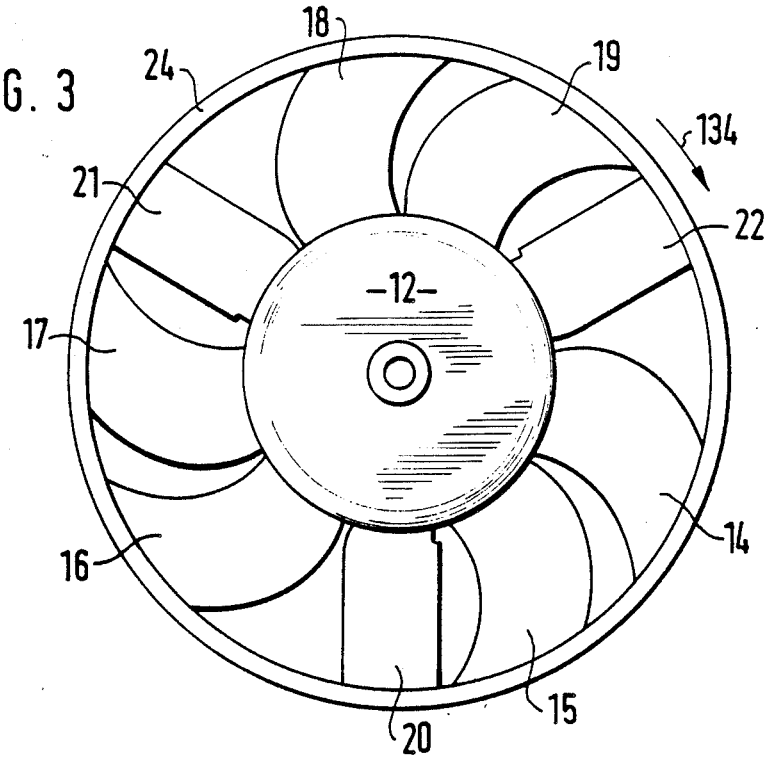
FIG. 3 is a plan view corresponding to the view of FIG. 1, but showing another embodiment of the invention impeller.

In the impeller shown in FIG. 3 the construction of the impeller corresponds to the construction of the impeller of FIGS. 1 and 2. Therefore the parts of the embodiment of FIG. 3 are identified with the same reference numerals as in the embodiment of FIGS. 1 and 2. One exception in the embodiment of FIG. 3 is that the sickle-shaped curved vane have a curvature which extends in the direction of rotation of the impeller as identified with reference numeral 134. These sickle-shaped vanes completely correspond to the vanes 14–19 of FIG. 1. Further, the impeller of FIG. 3 also has the outer ring 24 with a so-called inlet radius 32 which is the same as described with respect to FIG. 2 of the previous embodiment. The impeller of the inventive construction can be used also when the curvature of the sickle-shaped vanes of the impeller are opposite. However, it can also be used when the curvature of the sickle-formed vanes extends in the rotary direction of the impeller.

Figure 4:
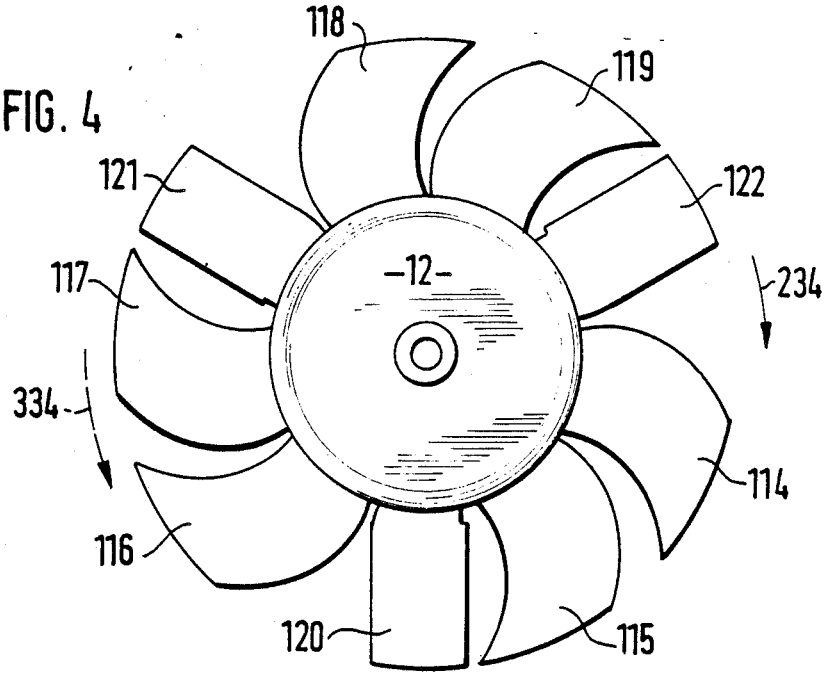
FIG. 4 is a plan view of an impeller in accordance with still another embodiment.

The impeller in accordance with the embodiment of FIG. 4 also has a central hub 12 and a plurality of vanes arranged on it and completely corresponding to the arrangement of the vanes of the impeller of FIG. 3. However, in this embodiment the outer ring 24 of the construction shown in FIG. 3 is not provided. The vanes have reference numerals which are greater by 100 than the vanes in the embodiment of FIG. 3. The rotary direction for the impeller of FIG. 4 is identified with an arrow 234. It is recommended that the impeller in FIG. 4 be also capable of rotating in the opposite direction. For this reason, a broken arrow 334 which is opposite to the arrow 234 is shown in FIG. 4. The impeller in accordance with the embodiment of FIG. 4 can also be utilized so that the curvature of the sickle-shaped vanes 114–119 is opposite to the direction of rotation of the impeller identified with arrow 234. On the other hand, it is recommended that the impeller in accordance with FIG. 4 is driven so that the curvature of the sickle-shaped vanes 114–119 can extend in the rotary direction of the impeller identified with arrow 334.

Figure 5:
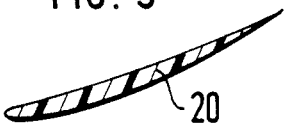
FIGS. 5 and 6 are views showing cross-sectional profiles of a vane of the impeller of FIG. 1, taken along the lines V—V and VI—VI, on an enlarged scale.
Figure 6:
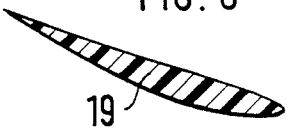

A further special feature of the inventive impeller is that the cross-sectional profiles of the vanes 14–19 or 114–119 have a sickle-shape which can differ from the cross-sectional profile of the vanes 20–22 and 120–122 whose contour deviates from the sickle-shape. The examples of different cross-sectional profiles are shown in FIGS. 5 and 6. The profile here is a profile which is known to specialists as a NACA-profile with a smaller curvature shown in FIG. 5 and a greater curvature shown in FIG. 6 blade profiles. It is to be understood that the profiles of respective vanes are exchangeable.

In the impellers of all embodiment of the present invention, two neighboring vanes 15, 16 or 17, 18 or 19, 14 of the same physical construction are provided therebetween with a vane 20, 21, 22 respectively with a construction which is different from this construction. Further, all shown impellers can be used with or without the outer ring. Finally, in each embodiment it is possible to curve the sickle-shaped vanes in the rotary direction 34 of the impeller or in a direction which is opposite to the rotary direction of the impeller.

It is, however, recommended that the impeller, the cross-sectional profiles of the vanes are different from one another. This can be true with respect to individual vanes or groups of vanes, regardless of how their constructions are determined relative to one another.

It will be understood that each of the elements described above, or two or more together, may also find a useful application in other types of constructions differing from the types described above.

While the invention has been illustrated and described as embodied in an impeller, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An impeller comprising a central hub part; a plurality of first vanes extending from said central hub part and all having a sickle-shaped cross-section of a predetermined size, said first vanes being spaced from each other and having an end remote from said central hub part; a plurality of second vanes extending from said central hub part and all having a shaped cross-section different from said sickle-shaped cross-section of said first vanes, said shaped cross-section of said second vanes being the same for all second vanes, and each of said second vanes being located in a space between two adjacent first vanes and having an end remote from said central hub part; and a ring surrounding the ends of said first and second vanes and being connected with said ends.

2. An impeller as defined in claim 1, wherein said ring has a radial size, and an axial size which is greater than said radial size.

3. An impeller as defined in claim 1, wherein said ring has an end side and is provided at said end side with a funnel-shaped expanded portion.

4. An impeller as defined in claim 3, wherein said funnel-shaped expanded portion has a cross-section with a uniform radius.

5. An impeller as defined in claim 1, wherein said first vanes have a sickle-shape with a curvature which is opposite to a direction of rotation of the impeller.

* * * * *